US008366100B2

(12) United States Patent
Tsuji

(10) Patent No.: US 8,366,100 B2
(45) Date of Patent: Feb. 5, 2013

(54) DISCHARGE TRAY APPARATUS

(75) Inventor: Masaru Tsuji, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 1373 days.

(21) Appl. No.: 12/022,188

(22) Filed: Jan. 30, 2008

(65) Prior Publication Data

US 2008/0186522 A1 Aug. 7, 2008

(30) Foreign Application Priority Data

Feb. 6, 2007 (JP) ..... 2007-027184

(51) Int. Cl.
*B65H 31/04* (2006.01)

(52) U.S. Cl. ..... 271/213; 271/221; 271/210; 271/218

(58) Field of Classification Search ..... 271/207, 271/210, 213, 218, 221; 270/58.11, 58.12
See application file for complete search history.

(56) References Cited

U.S. PATENT DOCUMENTS

| | | | | |
|---|---|---|---|---|
| 5,037,081 | A * | 8/1991 | Engelhardt et al. | 271/207 |
| 6,056,288 | A * | 5/2000 | Tsai et al. | 271/213 |
| 6,206,365 | B1 * | 3/2001 | Nanba et al. | 271/217 |
| 6,231,039 | B1 * | 5/2001 | Chung | 270/58.01 |
| 6,527,269 | B2 * | 3/2003 | Yamada et al. | 271/221 |
| 2002/0079642 | A1 * | 6/2002 | Tamura et al. | 271/207 |
| 2005/0206071 | A1 * | 9/2005 | Suzuki et al. | 271/207 |

FOREIGN PATENT DOCUMENTS

| | | | |
|---|---|---|---|
| JP | 59149264 | A * | 8/1984 |
| JP | 61086359 | A * | 5/1986 |
| JP | 63-147767 | A | 6/1988 |
| JP | 63-166561 | U | 10/1988 |
| JP | 64-51946 | U | 3/1989 |
| JP | 1-181673 | A | 7/1989 |
| JP | 11-130334 | | 5/1999 |

* cited by examiner

*Primary Examiner* — Prasad Gokhale
(74) *Attorney, Agent, or Firm* — Nixon & Vanderhye P.C.

(57) ABSTRACT

A discharge tray apparatus according to one embodiment of the present invention is a discharge tray apparatus wherein a plurality of sheets of recording paper that have been successively transported at a fixed speed and a fixed interval, discharged from a discharge opening, and have landed on a discharge tray, are received and placed onto the discharge tray, the discharge tray apparatus being provided with a discharge tray moving means that performs a tray shift operation that moves the discharge tray in a horizontal direction approximately perpendicular to the discharge direction, such that after a preceding paper successively transported earlier has been placed on the discharge tray, a succeeding paper succeedingly transported after the preceding paper is placed at a position different from the placement position of the preceding paper on the discharge tray. This discharge tray moving means performs the tray shift operation with a decelerating movement that reduces the movement speed of the discharge tray just before movement of the discharge tray stops.

8 Claims, 17 Drawing Sheets

DISCHARGE TRAY APPARATUS

CROSS-REFERENCE TO RELATED APPLICATION

This application claims priority under 35 U.S.C. §119(a) on Japanese Patent Application No. 2007-027184 filed in Japan on Feb. 6, 2007, the entire contents of which are herein incorporated by reference.

BACKGROUND OF THE TECHNOLOGY

1. Field of the Technology

The present technology relates to a discharge tray apparatus that is provided in a copier or the like configured based on an image recording apparatus, the discharge tray apparatus housing recorded recording paper that has been recorded with the image recording apparatus.

2. Description of the Related Art

Presently, copiers, facsimile machines, printing apparatuses, and the like are absolutely necessary for paperwork in offices. These copiers, facsimile machines, printing apparatuses, and the like are configured based on an image recording apparatus, and recorded paper that has been recorded with this image recording apparatus is released, discharged, and placed on a discharge tray of a discharge tray apparatus provided in the image recording apparatus.

In this sort of copier or the like provided with an image recording apparatus or a discharge tray apparatus, ordinarily, recording paper is used that is paper finished in a rectangle of a fixed size, such as A-size or B-size paper. Also, one bundle of one or a plurality of pages of recording paper on which a series of content has been recorded is ordinarily referred to as one copy, and in a copier or the like, a plurality of individual copies, i.e. a plurality of copies, are often created in successive copy operations.

In such a case, it is necessary to divide the plurality of copies into copy units, and so there are demands to provide the discharge tray apparatus with a structure that performs this division. In order to realize this structure, in the conventional art there have been various proposals with respect to the discharge tray apparatus.

As a representative conventional example of a structure that performs this division, there is a structure that performs a so-called tray shift operation of the discharge tray, in which each time that each copy of one group of recording paper released to the discharge tray of the discharge tray apparatus changes, the discharge tray is moved in the horizontal direction approximately perpendicular to the discharge direction of the recorded recording paper (for example, see JP H11-130334A).

In the structure described in JP H11-130334A, a rack, in which a gearwheel is linearly configured approximately perpendicular to the discharge direction of recorded recording paper, is provided laid out on the back face of a bottom portion of the discharge tray of the discharge tray apparatus, and by rotating a pinion, which is a gearwheel that engages with this rack, forward or in reverse at a fixed speed with a motor or the like, this structure performs the above-described tray shift operation.

As a structure that performs this tray shift operation, other than the above structure described in JP H11-130334A, there is the following sort of structure. Specifically, a solenoid is provided on the back face of a bottom portion of the discharge tray of the discharge tray apparatus, the solenoid performing back and forth movement in the direction approximately perpendicular to the discharge direction of the recorded recording paper via attraction and release, and thus this structure performs the tray shift operation.

As described above, by using the tray shift operation of the discharge tray apparatus, recorded recording paper is placed at a different position on the discharge tray of the discharge tray apparatus for each copy unit, so it is possible to easily divide a plurality of copies into copy units.

Incidentally, in recent copiers and the like, increased processing speed is sought, and with this increased processing speed, the discharge speed of recording paper to the discharge tray in the discharge tray apparatus is increased, and the interval between sheets of discharged recording paper is shortened. Also, there is an increase in the number of sheets of recording paper in each copy made up of one recording paper group.

However, when performing the tray shift operation in the above sort of discharge tray apparatus, when dividing successively released and discharged recording paper according to the order in which the recording paper was released and discharged, among the successively released and discharged recording paper, after a preceding paper that is recording paper released and discharged earlier has been released and discharged, it is necessary to complete the above tray shift operation before a succeeding paper that is recording paper released and discharged next is released and discharged. If this is not done, the recorded recording paper will not be properly placed at a different position on the discharge tray of the discharge tray apparatus for each copy unit.

Therefore, due to increased processing speed as described above in copiers and the like, the tray shift operation time in which the above tray shift operation is performed becomes very short. For example, in recent ordinary copiers and the like, the recording paper transport interval (the interval distance in transport between the trailing edge of the above preceding paper and the leading edge of the succeeding paper) is about 50 to 100 mm, and under such a condition, in consideration of the ordinary stiffness and flexibility of the transported recording paper, it is necessary that the time necessary for the tray shift operation be not more than 1 second.

By adopting such a configuration, in the above discharge tray apparatus that performs the tray shift operation using a rack and pinion, or in the discharge tray apparatus that performs the tray shift operation using a solenoid, the tray shift operation is performed in a short time period, so at the point in time that the tray shift operation is completed, a shock is applied to the bundle of recording paper that has been placed on the discharge tray of the discharge tray apparatus, and for example, as shown in FIGS. 16 and 17, this recording paper bundle becomes disorganized.

FIG. 16 is a plan view of, in the case of the above conventional example, a discharge tray 41 at the point in time of, for example, finishing performance of three instances of the tray shift operation, and FIG. 17 is a front view thereof. As is understood from FIGS. 16 and 17, in the direction that the tray shift operation was performed, the top layer of recording paper bundles PS1 to PS3 that have been placed on the discharge tray 41 has moved further to the outside in the shift operation direction than the lower layer, and thus these recording paper bundles PS1 to PS3 have become disorganized.

SUMMARY OF THE TECHNOLOGY

The present technology was made in view of the circumstances described above, and it is an object thereof to provide a discharge tray apparatus in which, when performing a tray shift operation of a discharge tray at high speed, it is possible to prevent a recording paper bundle that has been placed on the discharge tray from becoming disorganized.

The present technology provides a discharge tray apparatus in which a plurality of sheets of recording paper that have been successively transported at a fixed speed and a fixed interval, released and discharged in approximately the horizontal direction from a discharge opening, and have landed on a discharge tray from the leading edge to the trailing edge, are received and placed onto the discharge tray, the discharge tray apparatus comprising a discharge tray moving means that performs a tray shift operation that moves the discharge tray in a horizontal direction approximately perpendicular to the discharge direction, such that after a preceding paper successively transported earlier has been placed on the discharge tray, a succeeding paper succeedingly transported after the preceding paper is placed at a position different from the placement position of the preceding paper on the discharge tray, in which the discharge tray moving means performs the tray shift operation with a decelerating movement that reduces the movement speed of the discharge tray just before movement of the discharge tray stops.

With this configuration, it is possible to perform the tray shift operation with a deceleration movement that reduces the movement speed of the discharge tray just before the stop of movement of the discharge tray. Accordingly, it is possible to prevent the disorganization of a bundle of recording paper that has been placed on the discharge tray when the tray shift operation of the discharge tray is performed at high speed.

Also, in the discharge tray apparatus according to the present technology, a configuration may be adopted in which the discharge tray moving means performs the tray shift operation with an accelerating movement that increases the movement speed of the discharge tray just after movement of the discharge tray starts.

Also, in the discharge tray apparatus according to the present technology, a configuration may be adopted in which the discharge tray moving means performs the tray shift operation by movement at a uniform speed in which the movement speed of the discharge tray is constant between the accelerating movement and the decelerating movement.

With this configuration, it is possible to more meticulously prevent the disorganization of a bundle of recording paper that has been placed on the discharge tray when the tray shift operation of the discharge tray is performed at high speed.

Also, in the discharge tray apparatus according to the present technology, a configuration may be adopted in which the discharge tray moving means completes the tray shift operation within a discharge tray shift allowable period, which is a period from after the trailing edge of the preceding paper has separated from the discharge opening until the leading edge of the succeeding paper lands on the discharge tray.

With this configuration, it is possible to properly place recorded recording paper at different positions on the discharge tray of the discharge tray apparatus for each copy unit.

Also, in the discharge tray apparatus according to the present technology, a configuration may be adopted in which the discharge tray moving means controls the tray shift operation using as the value of the discharge tray shift allowable period a value that has been obtained in advance, by dividing the sum of the recording paper interval distance, which is the distance from the trailing edge of the preceding paper to the leading edge of the succeeding paper during transport, and the recording paper release distance, which is the horizontal distance from the discharge opening to the point where the leading edge of the recording paper landed on the discharge tray, by the transport speed of the recording paper.

As described above, it is necessary to adopt a configuration in which the time needed for the tray shift operation is within the discharge tray shift allowable period. More specifically, it is necessary that the tray shift operation is ended within the period from after the trailing edge of the preceding paper has separated from the discharge opening until the leading edge of the succeeding paper lands on the discharge tray.

The time from after the trailing edge of the preceding paper has separated from the discharge opening until the leading edge of the succeeding paper lands on the discharge tray is the time in which, after the trailing edge of the preceding paper has separated from the discharge opening, the succeeding paper transported through the recording paper interval distance from the preceding paper moves through the horizontal distance from the discharge opening to the point where the leading edge of the recording paper landed on the discharge tray.

More specifically, the above discharge tray shift allowable period is obtained by dividing the sum of the recording paper interval distance, which is the distance from the trailing edge of the preceding paper to the leading edge of the succeeding paper during transport, and the recording paper release distance, which is the horizontal distance from the discharge opening to the point where the leading edge of the recording paper landed on the discharge tray, by the transport speed of the recording paper.

Consequently, due to the discharge tray moving means controlling the tray shift operation using the discharge tray shift allowable period (time) obtained in this manner in advance, in the above discharge tray apparatus, it is possible to perform the tray shift operation such that it is possible to properly place recorded recording paper at different positions on the discharge tray of the discharge tray apparatus for each copy unit.

Also, in the discharge tray apparatus according to the present technology, a configuration may be adopted in which as the tray shift operation, the discharge tray moving means alternately performs a going shift operation of moving the discharge tray from a start point to an end point in a horizontal direction approximately perpendicular to the discharge direction, and a reversing shift operation of returning from the end point to the start point.

With this configuration, it is possible to simply configure the tray shift operation of the discharge tray moving means.

Also, in the discharge tray apparatus according to the present technology, the discharge tray moving means may be specifically configured to bias the discharge tray with a biasing member from one side toward the other side in the horizontal direction approximately perpendicular to the discharge direction, and to perform the going shift operation by, from the other side toward the one side in the horizontal direction approximately perpendicular to the discharge direction, causing the discharge tray to contact a near point on the outer circumference of an eccentric cam, then rotating the eccentric cam a half turn at a fixed speed to cause the discharge tray to contact a far point on the outer circumference of the eccentric cam, and perform the reversing shift operation by rotating the eccentric cam in the same direction a further half turn at a fixed speed.

Also, the outer shape of the eccentric cam in this case may be such that in the first half turn of the eccentric cam, during the first ⅙ turn, the cam diameter increment, which is the increment of the distance from the rotational axis of the eccentric cam until arriving at a point on the outer circumference of the eccentric cam whenever advancing a unit rotation angle of the eccentric cam, increases, and during the next ⅙ turn, the cam diameter increment whenever advancing the unit rotation angle is fixed, and further, during the next ⅙ turn, the cam diameter increment whenever advancing the unit rotation angle is reduced, and in the remaining half turn of the eccentric cam, during the first ⅙ turn, the cam diameter decrement, which is the decrement of the distance from the rotational axis of the eccentric cam until arriving at a point on the outer circumference of the eccentric cam whenever advancing a unit rotation angle of the eccentric cam, increases, and during the next ⅙ turn, the cam diameter decrement whenever advancing the unit rotation angle is fixed, and further, during the next ⅙ turn, the cam diameter decrement whenever advancing the unit rotation angle is reduced.

By using an eccentric cam with the above sort of outer shape, it is possible to, with the first half turn of the eccentric cam, perform the going shift operation of the discharge tray by accelerating movement just after starting movement of the discharge tray, decelerating movement just before stopping movement of the discharge tray, and movement at a uniform speed between the accelerating movement and the decelerating movement. It also is possible to perform the reversing shift operation in a similar manner in the remaining half turn. Accordingly, it is possible to realize the discharge tray moving means of the discharge tray apparatus according to the present technology with a simple configuration.

Also, in the discharge tray apparatus according to the present technology, the discharge tray moving means may be configured to control the rotational speed of the eccentric cam not at a fixed speed, but in the following manner. Specifically, the discharge tray moving means may be configured such that in the first half turn of the eccentric cam with the above outer shape, during the first ⅙ turn, the rotational speed of the eccentric cam is increased, and during the next ⅙ turn, the rotational speed of the eccentric cam is fixed, and further, during the next ⅙ turn, the rotational speed of the eccentric cam is reduced, and in the remaining half turn of the eccentric cam, the rotational speed of the eccentric cam is defined in the same way as defined in the first half turn.

With this configuration, in the going shift operation performed with the above-described first half turn of the eccentric cam, it is possible to further reinforce the effect of accelerating movement of the discharge tray just after starting movement of the discharge tray, decelerating movement of the discharge tray just before stopping movement of the discharge tray, and moving at a uniform speed between the above accelerating movement and decelerating movement. It is also possible to likewise reinforce the reversing shift operation in the remaining half turn.

DESCRIPTION OF THE PREFERRED EMBODIMENTS

Figure 1:
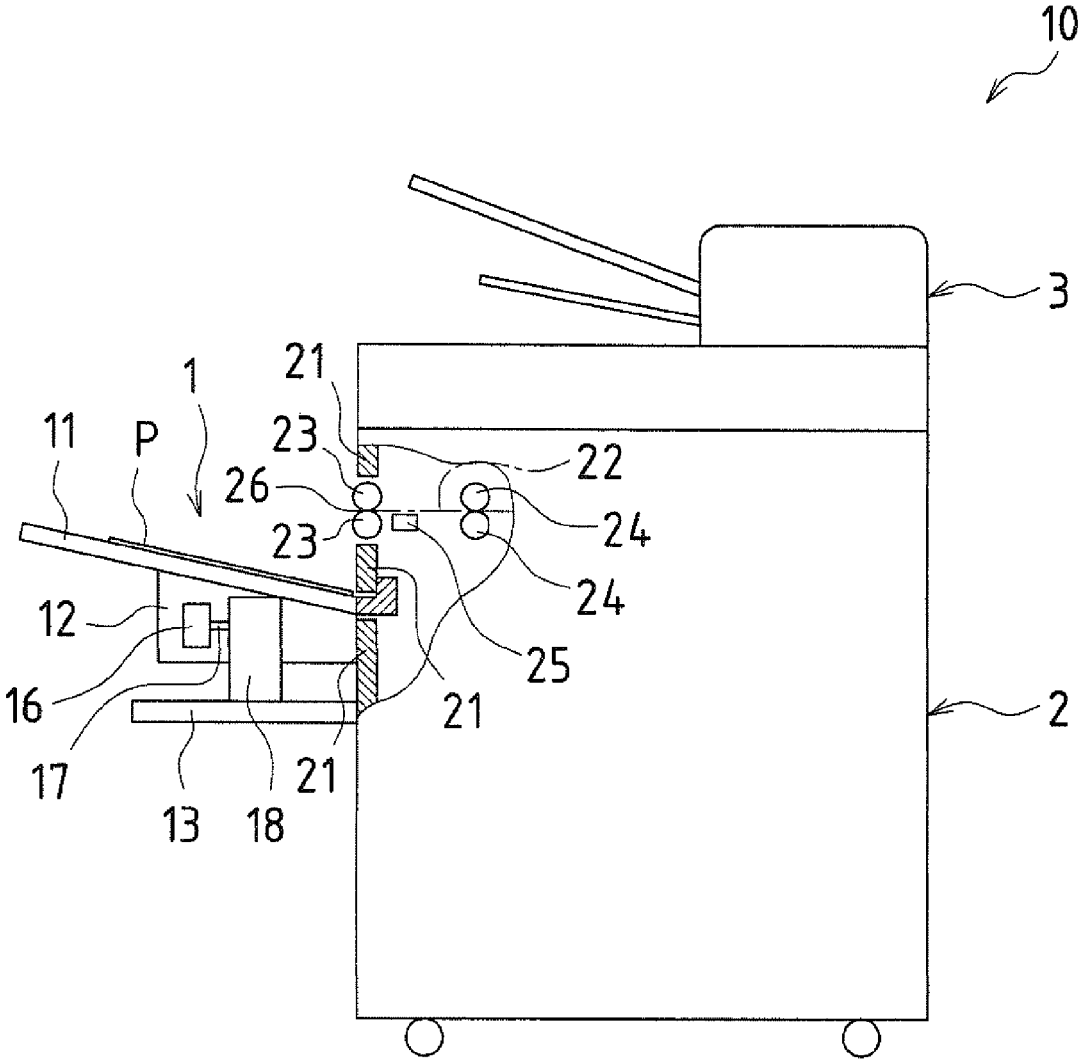
FIG. 1 is a right side view of a copier provided with a discharge tray apparatus according to an embodiment of the present technology.

Hereinafter, a discharge tray apparatus of an embodiment of the present technology will be described with reference to the drawings, using as an example a copier provided with the discharge tray apparatus of the present embodiment. FIG. 1 is right side view of a copier 10. This copier 10 is configured with an image recording apparatus 2, an original reading apparatus 3 provided above the image recording apparatus 2, and a discharge tray apparatus 1 of an embodiment of the present technology provided in a front portion case 21 of the image recording apparatus 2.

In the copier 10, from an original in the form of a piece of paper that has been placed in the original reading apparatus 3, image information is read with the original reading apparatus 3, which is provided with an optical scanner, and based on this image information, a recording image is formed on a recording paper P by the image recording apparatus 2. More specifically, in the image recording apparatus 2, a photosensitive body that has been charged to a uniform electric potential is exposed with light corresponding to the image information to form an electrostatic latent image, and the formed electrostatic latent image is made visible by developing the formed electrostatic latent image with toner, which is a developer. Further, this image that has been made visible with toner is transferred to the recording paper P, the toner on the recording paper P that has been transferred is fixed with a fixing portion, and thus a fast recording image is formed. Then, the recorded recording paper P on which this recording image has been formed is released and discharged from a discharge opening 26, and thus placed on a discharge tray 11 of the discharge tray apparatus 1.

Figure 2:
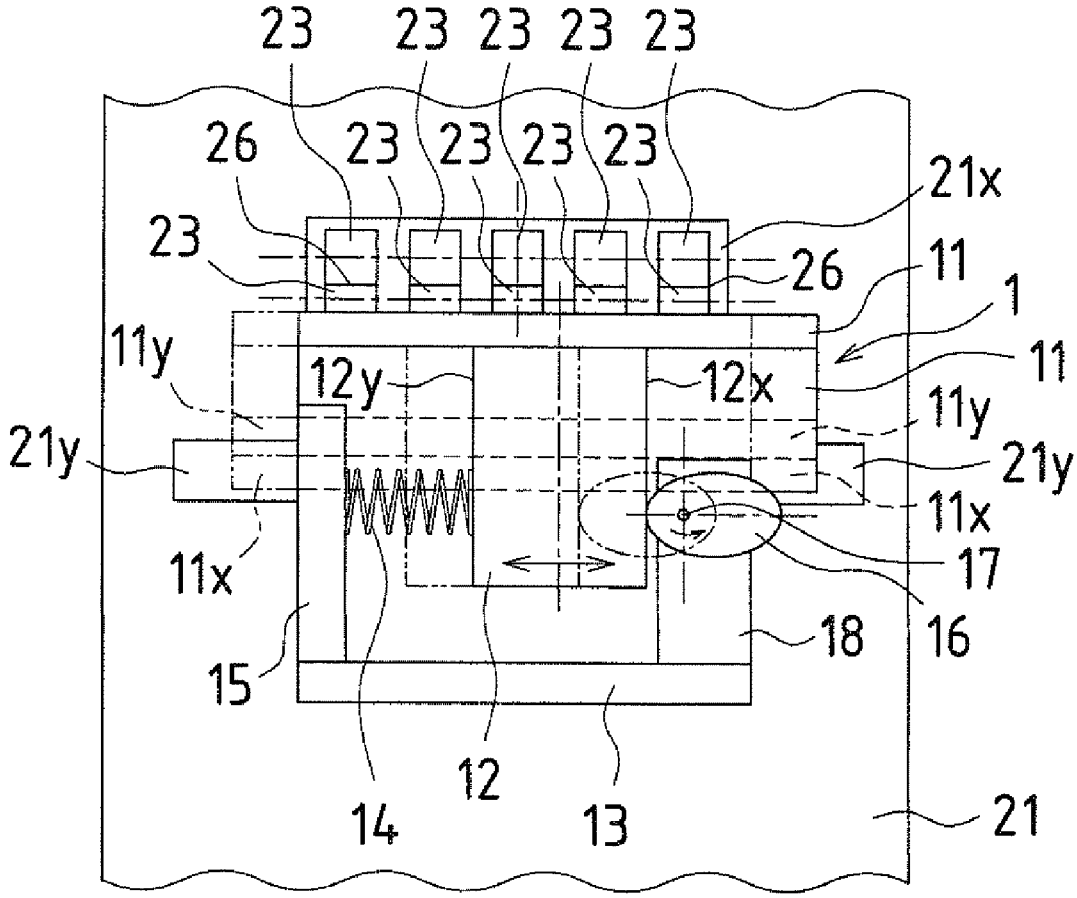
FIG. 2 is a front view of a discharge tray apparatus according to an embodiment of the present technology.
Figure 3:
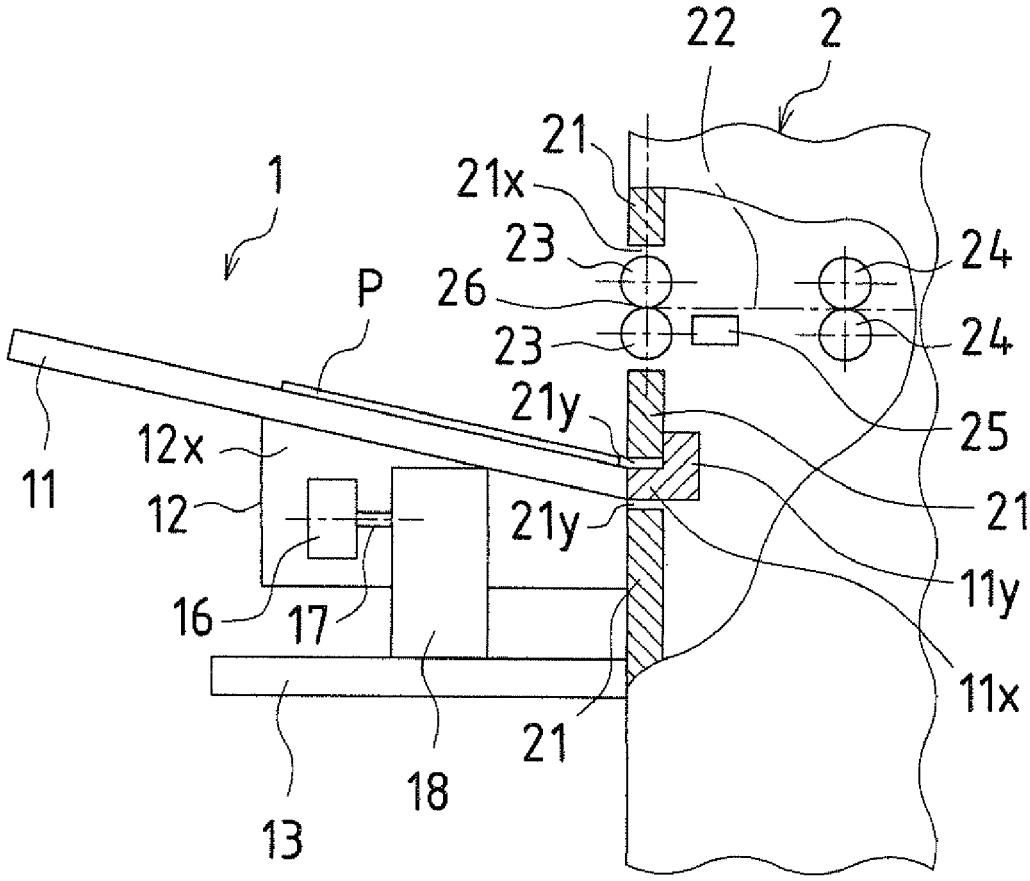
FIG. 3 is a right side view of a discharge tray apparatus according to an embodiment of the present technology.

FIG. 2 is a front view of the discharge tray apparatus 1 of the present embodiment provided in the above-described copier 10, and FIG. 3 is a right side view thereof. In FIG. 2, the left to right direction is the widthwise direction, and the top to bottom direction is the heightwise direction. Also, in FIGS. 1 and 3, the left side is the front direction, the right side is the rear direction, and the top to bottom direction is the heightwise direction.

In the discharge tray apparatus 1 in the present embodiment, in the copier 10, a tray shift operation is performed for the discharge tray 11 in order to divide a plurality of copies of the recording paper P on which an image has been recorded into copy units.

In FIGS. 2 and 3, the discharge tray apparatus 1 in the present embodiment is provided in the front portion case 21 of the image recording apparatus 2, as described above. More specifically, the discharge tray 11 of the discharge tray apparatus 1 has a plate-like form, and is formed with the front end thereof gradually sloping so as to tilt upward in the frontward direction from the front face of the front portion case 21, and this plate-like portion has a rectangular shape that is somewhat longer in the front to rear direction than in the widthwise direction. The recorded recording paper P on which an image has been recorded is placed on the upper face of the discharge tray 11.

The front end of a horizontal plate-like discharge tray slide portion 11*x* is linked to the base end of the discharge tray 11, and a perpendicular plate-like discharge tray holding portion 11*y* is linked to the rear end of the discharge tray slide portion 11*x*. That is, the discharge tray 11, the discharge tray slide portion 11*x*, and the discharge tray holding portion 11*y* are formed as a single body, and have a single body structure. Within this structure, the discharge tray slide portion 11*x* and the discharge tray holding portion 11*y* are configured such that the cross-sectional face where these have been combined has an L-shape.

In the front portion case 21 of the image recording apparatus 2, a discharge tray slide groove 21*y* is provided that is a horizontal rectangular groove left to right, and the discharge tray slide portion 11*x* that is linked to the base end of the discharge tray 11 intrudes into the discharge tray slide groove 21*y*. The front face of the discharge tray holding portion 11*y* that has a perpendicular plate-like shape and is linked to the discharge tray slide portion 11*x* is in contact with the rear face of the front portion case 21. Due to contact with the rear face of the case 21 of the discharge tray holding portion 11*y*, the discharge tray 11 is held in a state sloping upward to the front.

The discharge tray slide groove 21*y* is configured such that the width of the discharge tray slide groove 21*y* is wider than the width of the discharge tray 11. Thus, the discharge tray slide portion 11*x* can freely move by sliding left or right within the discharge tray slide groove 21*y*. That is, the discharge tray 11 operates to shift in the left-right direction, i.e. in the widthwise direction. This operation of the discharge tray 11 to shift in the widthwise direction is the tray shift operation described above.

A discharge tray leg portion 12 in the form of a sliding stand is linked to the lower face of the discharge tray 11. The discharge tray leg portion 12 is about ⅓ as wide as the discharge tray 11, and is about ⅖ as long from front to back as the discharge tray 11.

The upper face of the discharge tray leg portion 12 slopes upward toward the front, and is fixed to the lower face of the discharge tray 11. That is, the discharge tray 11 and the discharge tray leg portion 12 are formed as a single body, and have a single body structure. Also, a right side face 12*x* and a left side face 12*y* of the discharge tray leg portion 12 are parallel to the side ends of the rectangular discharge tray 11. The rear face of the discharge tray leg portion 12 contacts the front face of the front portion case 21, and in cooperation with the above-described contact of the discharge tray holding portion 11*y* with the rear face of the case 21, holds the discharge tray 11 in a state sloping upward to the front.

Below the discharge tray leg portion 12, i.e. below the discharge tray 11, a shift member support stand 13 is provided whose front end protrudes frontward horizontally from the front face of the case 21, and the base end of the shift member support stand 13 is fixed to the front face of the case 21.

On the upper face of the shift member support stand 13, a spring support piece 15 is perpendicularly provided upward along the left edge. Between the right side face of the spring support piece 15 and the left side face 12*y* of the discharge tray leg portion 12 fixed to the lower face of the discharge tray 11, a spring 14 is held sandwiched, and with the spring 14, the left side face 12*y* of the discharge tray leg portion 12 is pressed against, so that the discharge tray leg portion 12, i.e. the discharge tray 11 that is a single body structure with the discharge tray leg portion 12, is biased in the rightward direction.

Also, on the upper face of the shift member support stand 13, at the right edge, an eccentric cam drive portion 18 is installed. The eccentric cam drive portion 18 is provided with a square case, and inside this case a motor and a group of gears are built in. An eccentric cam shaft 17 protrudes horizontally frontward from the front face of the case of the eccentric cam drive portion 18, and the base end of the eccentric cam shaft 17 is directly linked to the group of gears inside the case of the eccentric cam drive portion 18.

Figure 4:
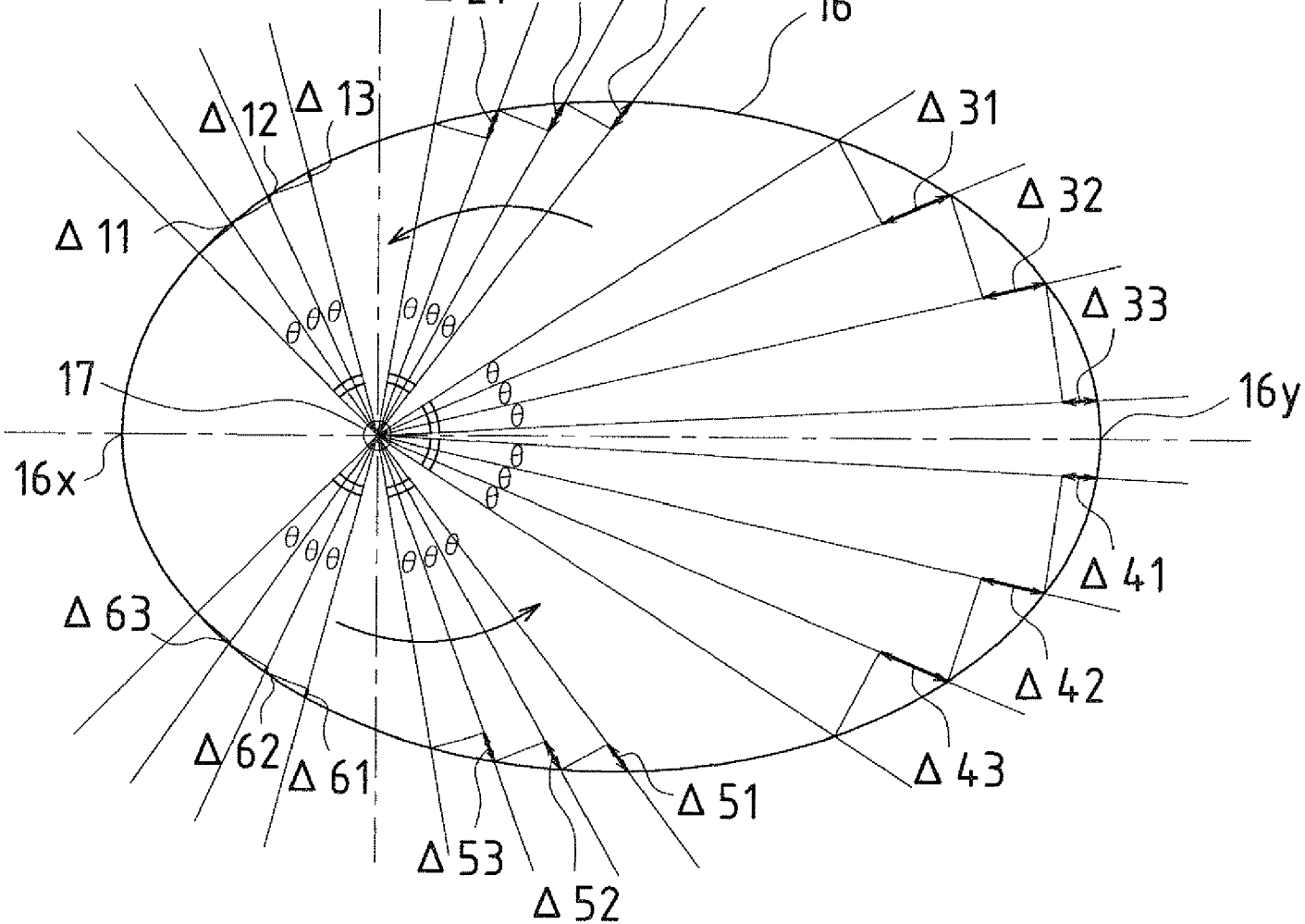
FIG. 4 is a front view of an eccentric cam used in a discharge tray apparatus according to an embodiment of the present technology.

An eccentric cam 16 is fixed to the front end of the eccentric cam shaft 17 protruding from the front face of the case of the eccentric cam drive portion 18. As shown in FIG. 4, the eccentric cam 16 has an approximately elliptical shape when viewed from the front, and with the eccentric cam shaft 17 as a center axis, rotates, in FIG. 2, on a perpendicular plane at a fixed speed in the counter clockwise direction when viewed from the front, due to the motor built into the eccentric cam drive portion 18. The outer circumferential edge of the eccentric cam 16 contacts the right side face 12*x* of the discharge tray leg portion 12. Also, the eccentric cam 16 has a shape that is symmetric up-down and left-right, with the long axis and the short axis being symmetrical axes.

Therefore, due to the outer circumferential edge of the eccentric cam 16 pressing against the right side face 12*x* of the discharge tray leg portion 12, and the above-described biasing by the spring 14 that presses against the left side face 12*y* of the discharge tray leg portion 12, the discharge tray 11 that has a single body structure with the discharge tray leg portion 12 moves left and right according to rotation of the eccentric cam 16. That is, the tray shift operation of the discharge tray 11 is performed by the rotational operation of the eccentric cam 16.

Specifically, at the start time, a near point 16*x* on the outer circumference of the eccentric cam 16 is made to contact the right side face 12*x* of the discharge tray leg portion 12, and by half-rotating the eccentric cam 16 at a fixed speed, a far point 16*y* on the outer circumference of the eccentric cam 16 is made to contact the right side face 12*x* of the discharge tray leg portion 12, thus performing a going shift operation. By further half-rotating the eccentric cam 16 at a fixed speed in the same direction, a reversing shift operation is performed.

More specifically, in the above-described discharge tray apparatus 1, the going shift operation of moving from the position of the discharge tray 11 that is positioned to the right side viewed from the front in FIG. 2 (referred to as the start point), to the position of the discharge tray 11 that is positioned to the left side viewed from the front in FIG. 2 (referred to as the end point), and the reversing shift operation of returning from the end point to the start point, are alternately performed.

Also, in the front portion case 21 of the image recording apparatus 2, a release window 21*x* is provided above the above-described discharge tray slide groove 21*y* provided in the front portion case 21. In this release window 21*x*, five pairs of release rollers 23 are disposed in the horizontal direction, each being a pair that are vertically joined and have rotating shafts horizontal in the left-right direction with the same radius. Also, inside the front portion case 21, to the rear of these pairs of release rollers 23, likewise, five pairs of transport rollers 24 are disposed in the horizontal direction, being of the same type as the release rollers 23, each being a pair that have rotating shafts horizontal in the left-right direction.

A recording paper transport path 22, where the recording paper P on which an image has been formed with the image recording apparatus 2 is transported, is formed by a common horizontal plane that passes through both the tangent line where the release rollers 23 are vertically joined and the tangent line where the transport rollers 24 are vertically joined. Also, a recording paper detection unit 25 that detects the presence of recording paper P to be transported through the recording paper transport path 22 is provided near the release rollers 23 of the recording paper transport path 22. The recording paper detection unit 25 detects the presence of recording paper P while the recording paper P is passing over the recording paper detection unit 25 by turning on.

Recording paper P that has been transported through the recording paper transport path 22 by the above-described transport rollers 24 passes over the recording paper detection unit 25 and turns on the recording paper detection unit 25, is released towards the upper face of the discharge tray 11 by the release rollers 23 and discharged, and thus is placed on the upper face of the discharge tray 11. The portion where the above-mentioned release rollers 23 are vertically joined is the above-described discharge opening 26, where the recording paper P is released and discharged.

The control of actual driving of the eccentric cam drive portion 18, and control of the release rollers 23 and the transport rollers 24, described above, is performed by an unshown image recording apparatus control portion provided inside the front portion case 21 of the image recording apparatus 2. Output of the aforementioned recording paper detection unit 25 is also taken in by the image recording apparatus control portion, and used in performing the above controls.

Following is a description of the operation of the discharge tray apparatus 1. First is a description of the tray shift operation of the discharge tray 11 of the discharge tray apparatus 1. As described above, the tray shift operation of the discharge tray 11 is performed by the eccentric cam 16 rotating at a fixed speed in the counter clockwise direction when viewed from the front.

FIG. 4 is a front view of the eccentric cam 16, showing the shape of the eccentric cam 16 when viewed from the front. As described above, the shape of the eccentric cam 16 is symmetrical from top to bottom and left to right, with the long axis and the short axis being symmetrical axes. Also, as described above, using the eccentric cam shaft 17 as the axis of rotation, the eccentric cam 16 rotates at a fixed speed in the counter clockwise direction when viewed from the front.

With respect to the outer shape of the above-described eccentric cam 16, a shape is adopted such that in the first half turn in the counter clockwise direction of the eccentric cam 16, during the first ⅙ turn, the cam diameter increment (Δ11, Δ12, and Δ13 in FIG. 4), which is the increment of the distance from the rotational axis of the eccentric cam 16 until arriving at a point on the outer circumference of the eccentric cam 16 whenever advancing a unit rotation angle θ of the eccentric cam 16, increases, and during the next ⅙ turn, the cam diameter increment (Δ21, Δ22, and Δ23 in FIG. 4) whenever advancing a unit rotation angle θ is fixed, and further, during the next ⅙ turn, the cam diameter increment (Δ31, Δ32, and Δ33 in FIG. 4) whenever advancing a unit rotation angle θ is reduced.

Also, in the same manner, as the outer shape of the above-described eccentric cam 16, a shape is adopted such that in the remaining half turn of the eccentric cam 16, during the first ⅙ turn, the cam diameter decrement (Δ41, Δ42, and Δ43 in FIG.

4), which is the decrement of the distance from the rotational axis of the eccentric cam 16 until arriving at a point on the outer circumference of the eccentric cam 16 whenever advancing a unit rotation angle θ of the eccentric cam 16, increases, and during the next ⅙ turn, the cam diameter decrement (Δ51, Δ52, and Δ53 in FIG. 4) whenever advancing a unit rotation angle θ is fixed, and further, during the next ⅙ turn, the cam diameter decrement (Δ61, Δ62, and Δ63 in FIG. 4) whenever advancing a unit rotation angle θ is reduced.

By adopting such a shape, with the first half turn of the eccentric cam 16, with respect to the going shift operation, it is possible to accelerate movement of the discharge tray 11 just after starting movement of the discharge tray 11, and possible to decelerate movement of the discharge tray 11 just before stopping movement of the discharge tray 11, and additionally, it is possible to move at a uniform speed between the above accelerating movement and decelerating movement. Also in the remaining half turn, it is possible to perform the reversing shift operation in the same manner.

Figure 5:
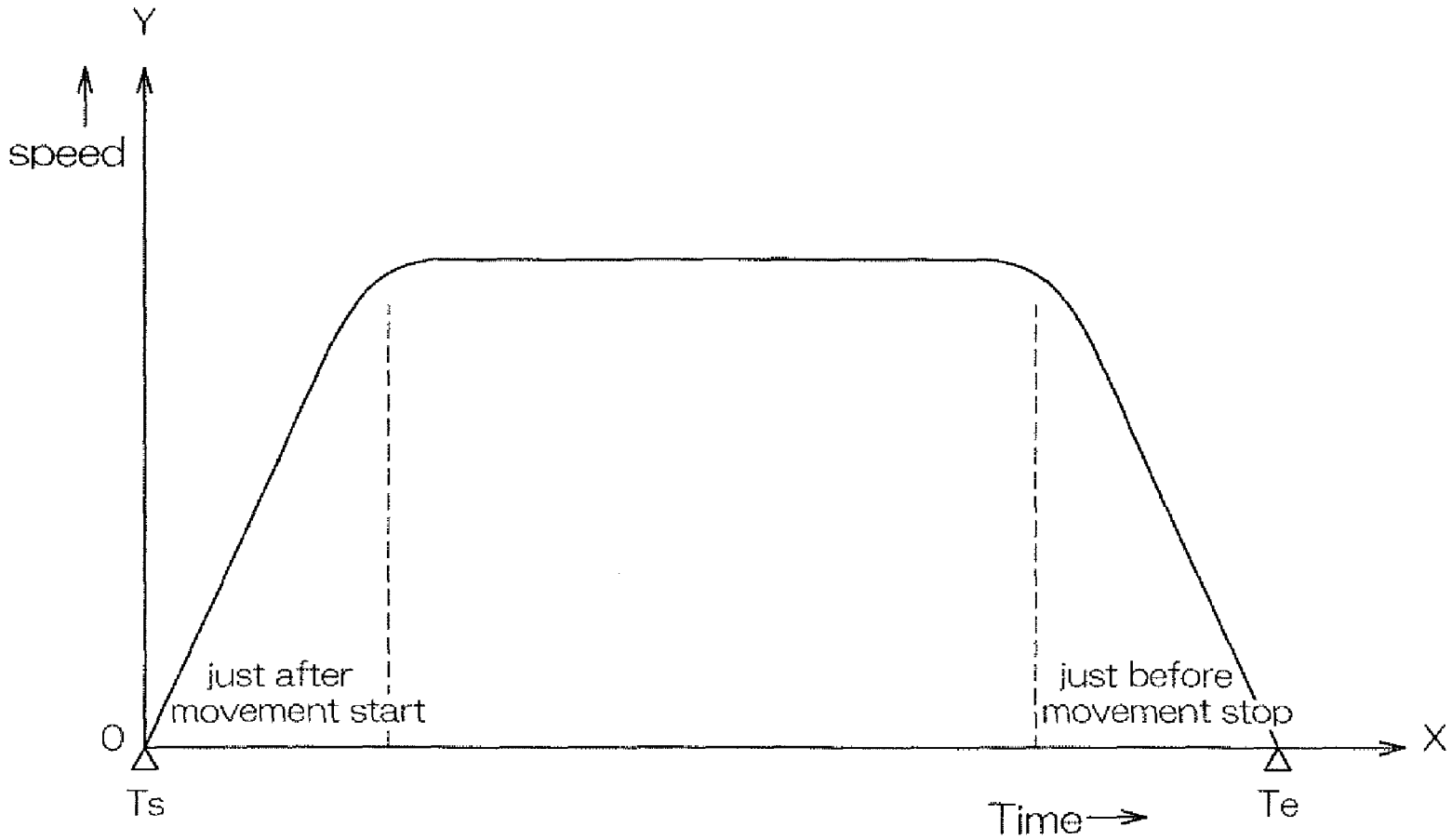
FIG. 5 is a graph that shows the speed of a tray shift operation of a discharge tray apparatus according to an embodiment of the present technology.

In FIG. 5 this state is expressed in a graph. In FIG. 5, the movement speed of the tray shift operation of the discharge tray 11 is shown on the vertical axis, and time is shown on the horizontal axis. Ts is the tray shift operation start time, and Te is the tray shift operation end time. Specifically, when the near point 16*x* on the outer circumference of the eccentric cam 16 is in contact with the right side face 12*x* of the discharge tray leg portion 12 at Ts, Te is the time at which the far point 16*y* on the outer circumference of the eccentric cam 16 contacted the right side face 12*x* of the discharge tray leg portion 12. Also, when the far point 16*y* on the outer circumference of the eccentric cam 16 is in contact with the right side face 12*x* of the discharge tray leg portion 12 at Ts, Te is the time at which the near point 16*x* on the outer circumference of the eccentric cam 16 contacted the right side face 12*x* of the discharge tray leg portion 12.

From FIG. 5 it is understood that with respect to the tray shift operation of the discharge tray 11, there is accelerating movement just after starting movement of the discharge tray 11, and there is decelerating movement just before stopping movement of the discharge tray 11, and between the above accelerating movement and decelerating movement, the discharge tray 11 moves at a uniform speed.

Next is a description of the relationship between transport of recording paper P in the discharge tray apparatus 1 and the timing of release and discharge from the discharge opening 26, and the tray shift operation of the discharge tray 11. To properly place recording paper P at different positions on the discharge tray 11 in order to divide a plurality of copies of the recorded recording paper P into copy units, it is necessary to complete the tray shift operation of the discharge tray 11 in the period of time after, among successively released and discharged recording paper P, a preceding paper that is recording paper P released and discharged earlier has separated from the discharge opening 26, and before a state in which the leading edge of a succeeding paper that is recording paper P released and discharged next has landed on the discharge tray 11. This period of time is referred to as a discharge tray shift allowable period.

FIGS. 6 to 13 illustrate this state. In FIGS. 6 to 13, P1 indicates the aforementioned preceding paper, P2 indicates the aforementioned succeeding paper, and P3 indicates a succeeding paper that is transported and discharged after the succeeding paper P2. FIGS. 6 to 13 illustrate a state in which the preceding paper P1 and the succeeding paper P2 are placed at different positions on the discharge tray 11.

In the description of this state, initially, the aforementioned near point 16*x* on the outer circumference of the eccentric cam 16 is in contact with the right side face 12*x* of the discharge tray leg portion 12. That is, in FIG. 6, in a state in which the near point 16*x* on the outer circumference of the eccentric cam 16 is in contact with the right side face 12*x* of the discharge tray leg portion 12, the discharge tray 11 is stopped. In this state, in FIG. 2, the discharge tray 11 is positioned toward the right side when viewed from the front.

Figure 6:
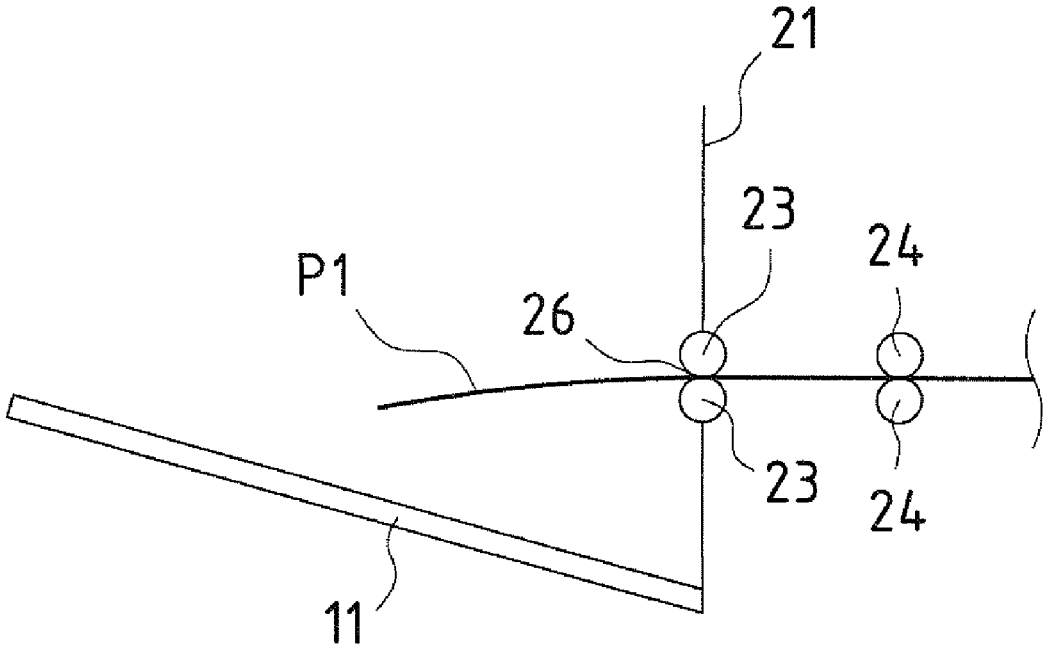
FIG. 6 is an illustrative diagram that shows the relationship between recording paper transport, discharge timing, and the tray shift operation of a discharge tray of a discharge tray apparatus according to an embodiment of the present technology, and shows a state in which, while a preceding paper is being transported through a recording paper transport path with a transport roller, the preceding paper is being released with a release roller from a discharge opening.
Figure 7:
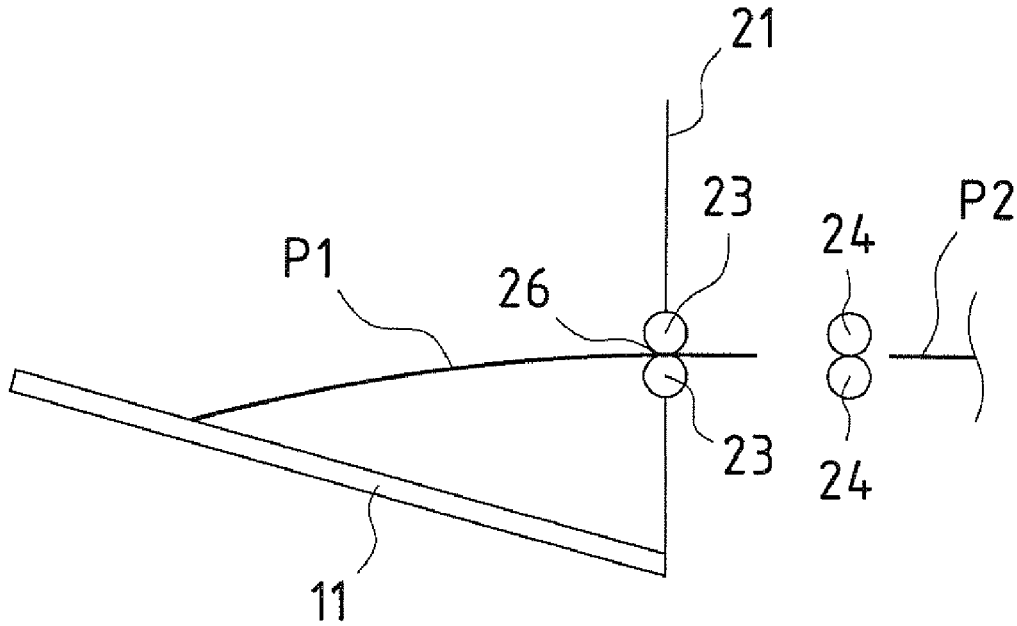
FIG. 7 is an illustrative diagram that shows the relationship between recording paper transport, discharge timing, and the tray shift operation of a discharge tray of a discharge tray apparatus according to an embodiment of the present technology, and shows a state in which the leading edge of a preceding paper has landed on a discharge tray, and succeeding the preceding paper, a succeeding paper is transported through a recording paper transport path toward the discharge opening with the transport roller.
Figure 8:
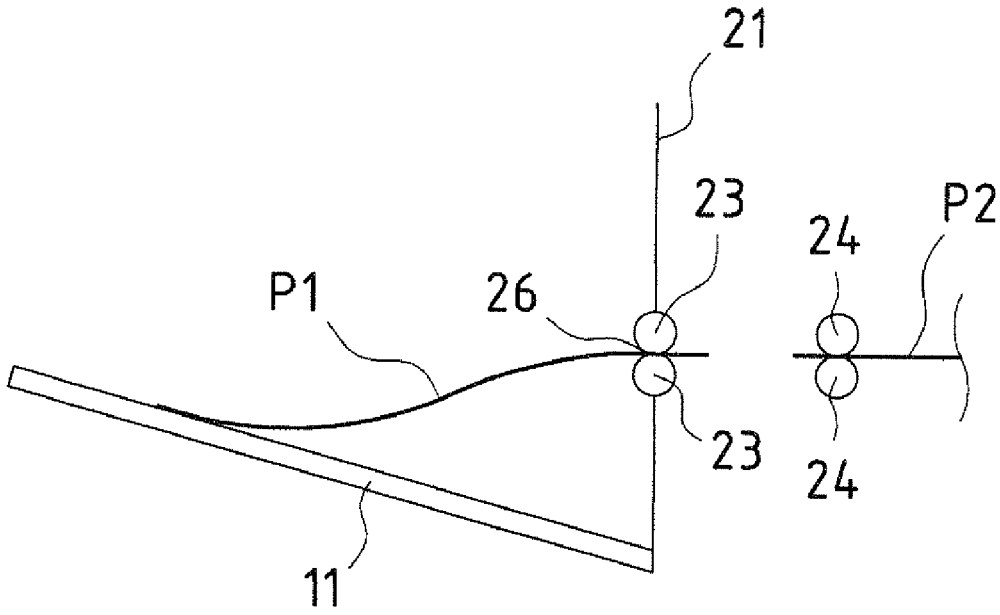
FIG. 8 is an illustrative diagram that shows the relationship between recording paper transport, discharge timing, and the tray shift operation of a discharge tray of a discharge tray apparatus according to an embodiment of the present technology, and shows a state in which although succeeding the preceding paper, the succeeding paper continues to be transported through the recording paper transport path toward the discharge opening with the transport roller, the trailing edge of the preceding paper has not yet separated from the discharge opening.

First, FIG. 6 shows the preceding paper P1 being transported through the recording paper transport path 22 with the transport rollers 24, and in the midst of being released from the discharge opening 26 with the release rollers 23 and discharged. Next, FIG. 7 shows a state in which the leading edge of the preceding paper P1 has landed on the upper face of the discharge tray 11. Also, FIG. 7 shows a state in which succeeding from the preceding paper P1, the succeeding paper P2 is being transported through the recording paper transport path 22 towards the discharge opening 26 with the transport rollers 24. FIG. 8 shows a state in which the state shown in FIG. 7 is proceeding, but the trailing edge of the preceding paper P1 has not yet separated from the discharge opening 26.

Figure 9:
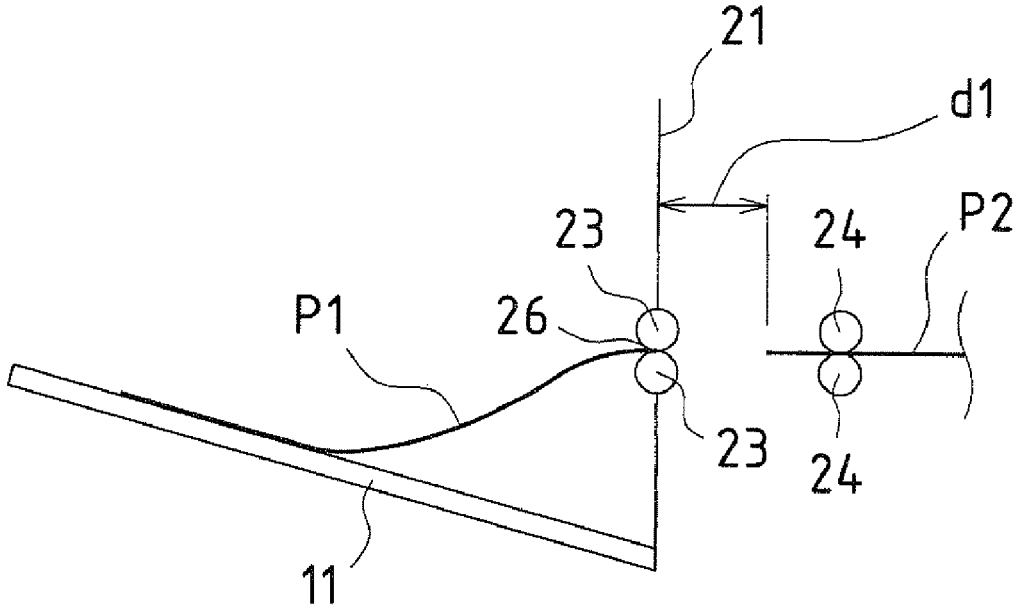
FIG. 9 is an illustrative diagram that shows the relationship between recording paper transport, discharge timing, and the tray shift operation of a discharge tray of a discharge tray apparatus according to an embodiment of the present technology, and shows a state in which the trailing edge of the preceding paper has separated from the discharge opening, and succeeding the preceding paper, the succeeding paper is being transported through the recording paper transport path toward the discharge opening with the transport roller.

Next, FIG. 9 shows a state in which the trailing edge of the preceding paper P1 has separated from the discharge opening 26. At this point, in this state, even if the tray shift operation of the discharge tray 11 is started, because the trailing edge of the preceding paper P1 has separated from the discharge opening 26, the preceding paper P1 moves as a single body with the discharge tray 11 in a state riding on the upper face of the discharge tray 1, which moves. Accordingly, even if the discharge tray 11 moves, the placement position of the preceding paper P1 on the discharge tray 11 does not move.

Also, FIG. 9 shows a state in which succeeding from the preceding paper P1, the succeeding paper P2 is being transported through the recording paper transport path 22 towards the discharge opening 26 with the transport rollers 24. In FIG. 9, d1 indicates a recording paper interval distance, which is the distance from the trailing edge of the preceding paper P1 to the leading edge of the succeeding paper P2 during transport. More specifically, during transport, the preceding and succeeding recording papers P are transported separated by the interval of the recording paper interval distance d1.

Figure 10:
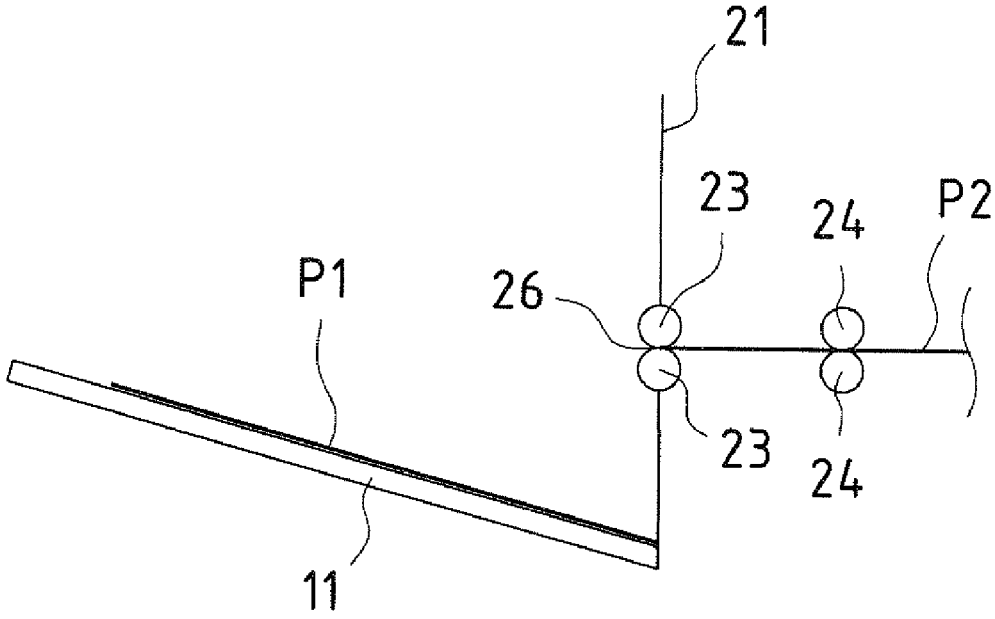
FIG. 10 is an illustrative diagram that shows the relationship between recording paper transport, discharge timing, and the tray shift operation of a discharge tray of a discharge tray apparatus according to an embodiment of the present technology, and shows a state in which the succeeding paper has been transported through the recording paper transport path with the transport roller and has arrived at the discharge opening, and the preceding paper has completely been placed on the discharge tray.
Figure 14:
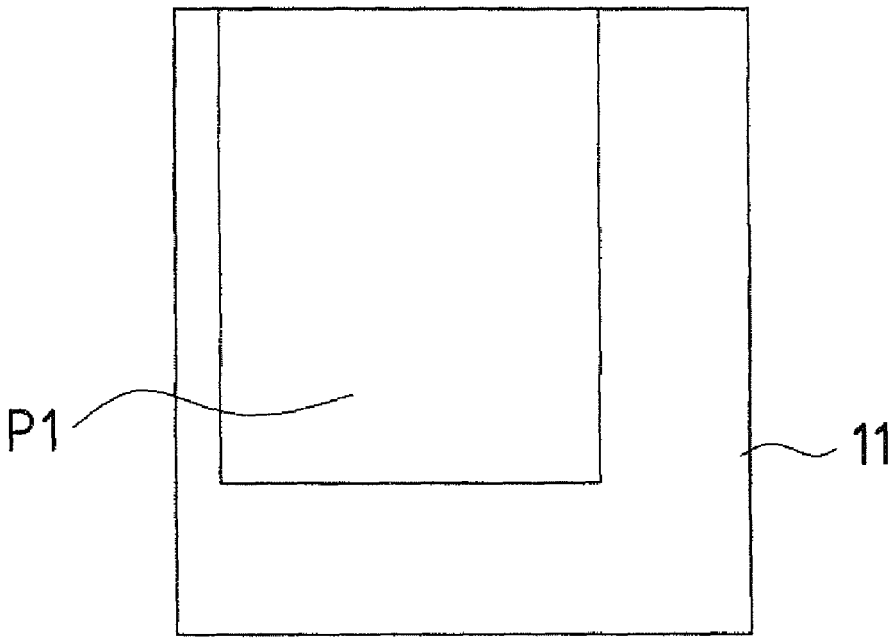
FIG. 14 is a plan view in which the discharge tray of the discharge tray apparatus in the present embodiment in the state shown in the explanatory diagram in FIG. 10 is viewed from above.

Next, FIG. 10 shows a state in which the succeeding recording paper P2 has been transported through the recording paper transport path 22 with the transport rollers 24, and has arrived at the discharge opening 26. Also, FIG. 10 shows a state in which the preceding paper P1 has been completely placed on the discharge tray 11. FIG. 14 shows a plan view in which the discharge tray 11 in this state is viewed from above. As is understood from FIG. 14, in this state, the preceding paper P1 is placed toward the left of the discharge tray 11. Also, in this state, even while the discharge tray 11 is moving due to the tray shift operation, the preceding paper P1 has already been placed on the discharge tray 11 and moves as a single body with the discharge tray 11, so the placement position of the preceding paper P1, placed on the discharge tray 11, does not move on the discharge tray 11.

Figure 11:
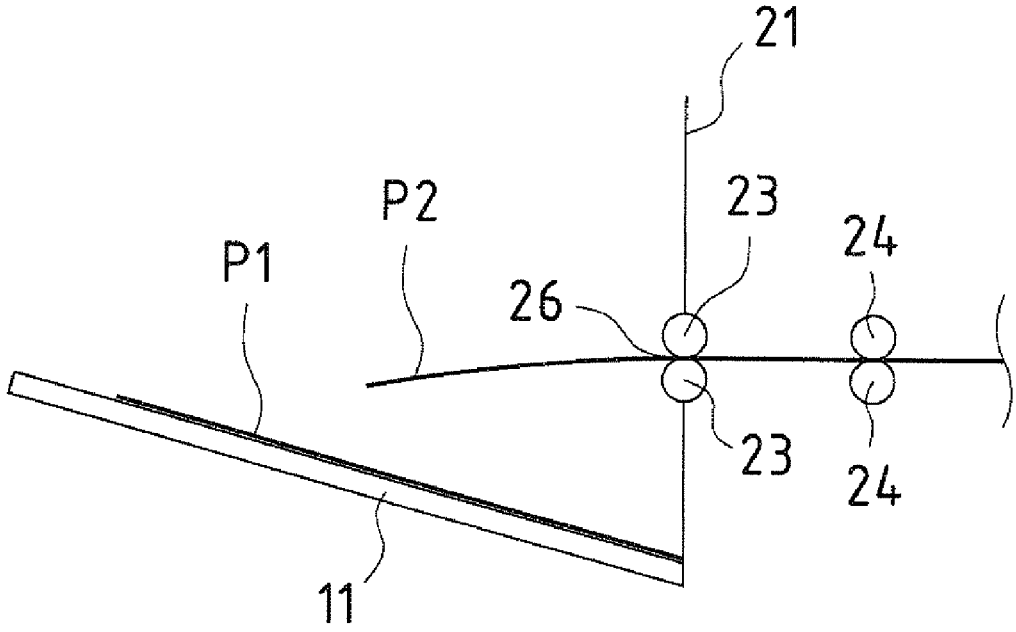
FIG. 11 is an illustrative diagram that shows the relationship between recording paper transport, discharge timing, and the tray shift operation of a discharge tray of a discharge tray apparatus according to an embodiment of the present technology, and shows a state in which, although a state continues in which the succeeding paper has been transported through the recording paper transport path with the transport roller and has arrived at the discharge opening, the leading edge of the succeeding paper has not yet landed on the discharge tray.

Next, FIG. 11 shows a state in which the state shown in FIG. 10 is proceeding, but the leading edge of the succeeding paper P2 has not yet landed on the discharge tray 11. Also, in this state, even while the discharge tray 11 is moving due to the tray shift operation, same as in the state shown in FIG. 10, the preceding paper P1 has already been placed on the discharge tray 11 and moves as a single body with the discharge tray 11, so the placement position of the preceding paper P1, placed on the discharge tray 11, does not move on the discharge tray 11.

Figure 12:
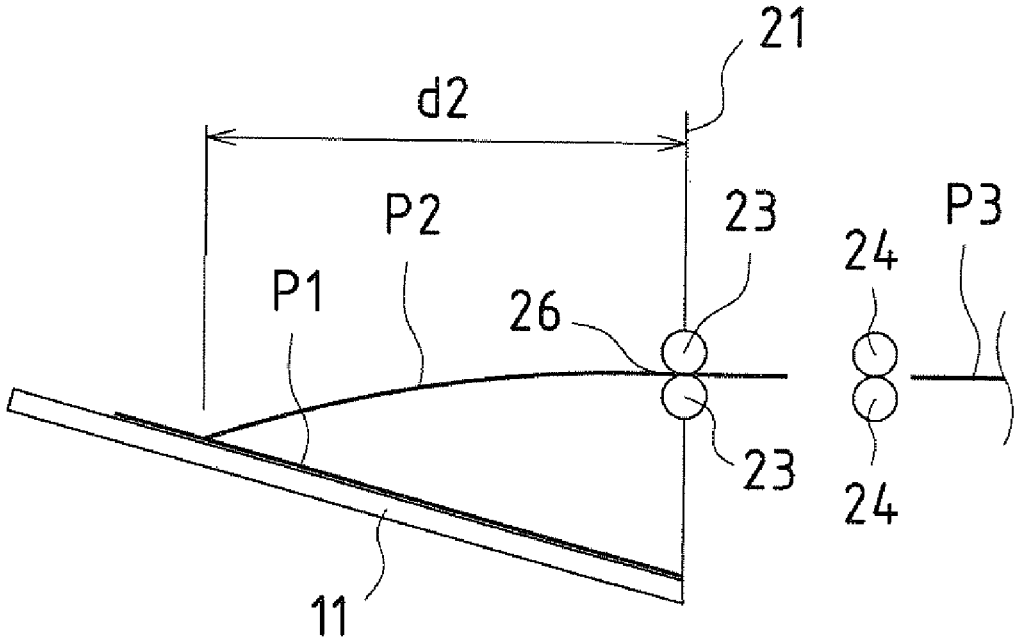
FIG. 12 is an illustrative diagram that shows the relationship between recording paper transport, discharge timing, and the tray shift operation of a discharge tray of a discharge tray apparatus according to an embodiment of the present technology, and shows a state in which the leading edge of the succeeding paper has landed on an upper face of the discharge tray.

Next, FIG. 12 shows a state in which the leading edge of the succeeding paper P2 has landed on the upper face of the discharge tray 11. In FIG. 12, d2 indicates a recording paper release distance, which is the distance from the position where the leading edge of the succeeding paper P2 has landed on the upper face of the discharge tray 11 to the discharge opening 26. More specifically, the recording paper P that has been transported is released and discharged such that the leading edge of the recording paper P lands at a point separated frontward from the discharge opening 26 by the recording paper release distance d2. Also, FIG. 12 shows a state in which succeeding from the succeeding paper P2, the succeeding paper P3 is being transported through the recording paper transport path 22 towards the discharge opening 26 with the transport rollers 24.

When the discharge tray 11 is moving due to the tray shift operation until reaching the state shown in FIG. 12, it is necessary that the tray shift operation is stopped before reaching this state. The reason for this is that if, in the state shown in FIG. 12, the discharge tray 11 is moving due to the tray shift operation, then the leading edge of the succeeding paper P2 will land on the upper face of the discharge tray 11 in the state shown in FIG. 12, so the leading edge of the succeeding paper P2 that has landed on the upper face of the discharge tray 11 is pulled out of position by the discharge tray 11 that moves due to the tray shift operation, and thus there is a risk that the placement position of the succeeding paper P2 on the discharge tray 11 will be moved out of position. Therefore, the tray shift operation of the discharge tray 11 in the state shown in FIG. 12 is in a stopped state.

Figure 15:
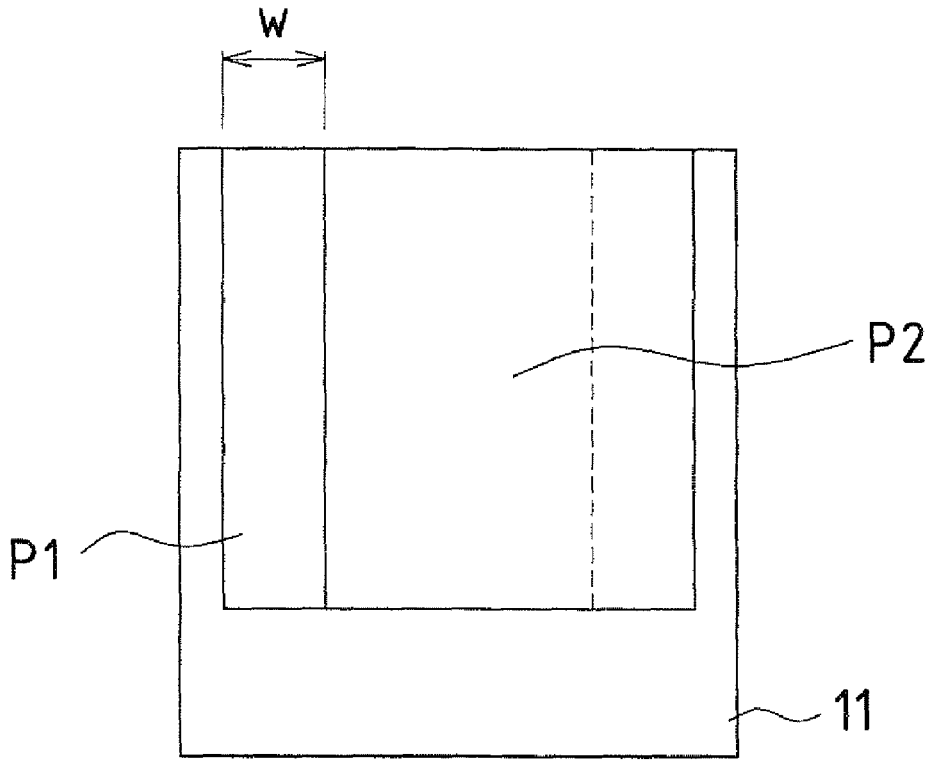
FIG. 15 is a plan view in which the discharge tray of the discharge tray apparatus in the present embodiment in a state in which, via the state shown in the explanatory diagram in FIG. 12, the succeeding paper has been completely placed on the discharge tray, is viewed from above.
Figure 16:
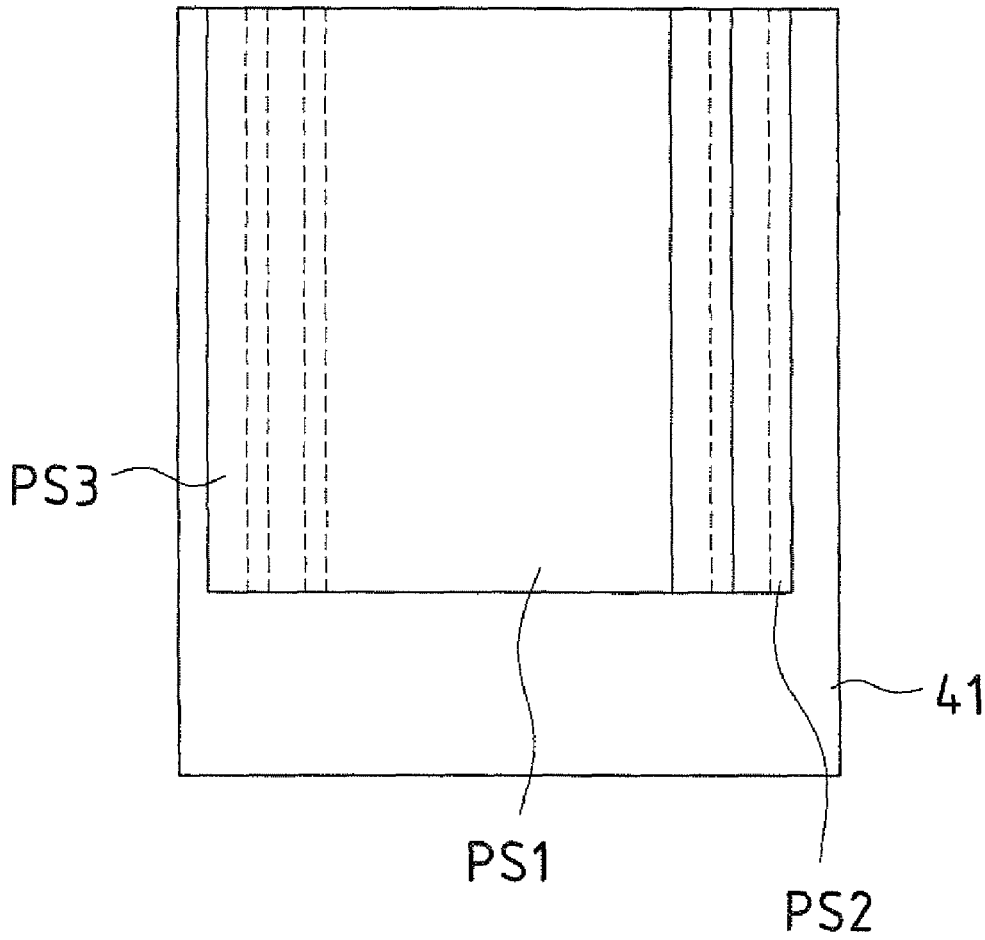
FIG.16 Prior Art
FIG. 16 is a plan view of a discharge tray in a copier or the like according to a conventional example.
Figure 17:
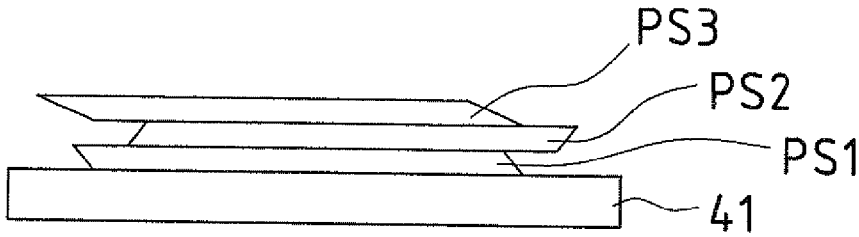
FIG.17 Prior Art
FIG. 17 is a front view of a discharge tray in a copier or the like according to the conventional example shown in FIG. 16.

Accordingly, the tray shift operation of the discharge tray 11 is started in the state shown in FIG. 9, and when the discharge tray 11 is stopped in the state shown in FIG. 12, in the state shown in FIG. 12, the discharge tray 11 is positioned towards the left side when viewed from the front in FIG. 2. FIG. 15 shows a plan view in which the discharge tray 11 is viewed from above in a state in which, from the state shown in FIG. 12, the succeeding paper P2 for which placement on the discharge tray 11 is started has been completely placed on the discharge tray 11. As is understood from FIG. 15, in a state in which the succeeding paper P2 has been completely placed on the discharge tray 11, the succeeding paper P2 is placed towards the right of the discharge tray 11, and is offset from the preceding paper P1 placed earlier in the left-right direction by a distance w.

Figure 13:
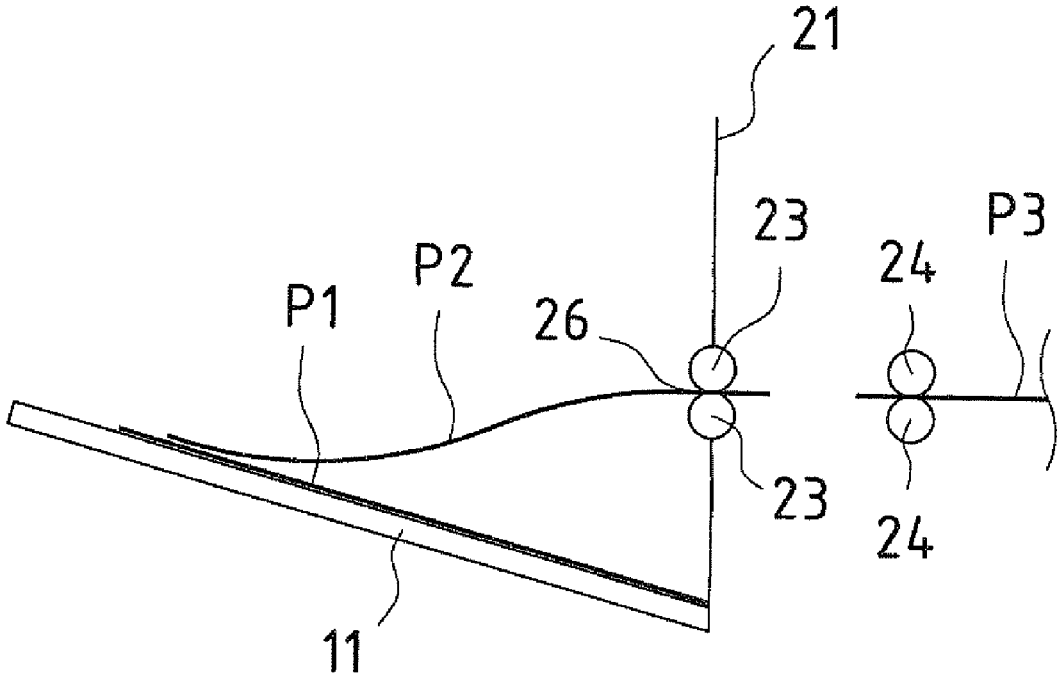
FIG. 13 is an illustrative diagram that shows the relationship between recording paper transport, discharge timing, and the tray shift operation of a discharge tray of a discharge tray apparatus according to an embodiment of the present technology, and shows a state in which, although a state continues in which the leading edge of the succeeding paper has landed on the upper face of the discharge tray, the trailing edge of the succeeding paper has not yet separated from the discharge opening.

Next, FIG. 13 shows a state in which although the state shown in FIG. 12 is proceeding, the trailing edge of the succeeding paper P2 has not yet separated from the discharge opening 26. In this state, it is necessary to stop the tray shift operation of the discharge tray 11. The reason for this is that if, in the state shown in FIG. 13, the discharge tray 11 is moving due to the tray shift operation, then the same sort of effect as that described above with reference to FIG. 12 will occur, so there is a risk that the placement position of the succeeding paper P2 on the discharge tray 11 will be moved out of position.

As is understood from the above description using FIGS. 6 to 13, to properly place recording paper P at different positions on the discharge tray 11 in order to divide a plurality of copies of the recorded recording paper P into copy units, it is necessary to complete the tray shift operation of the discharge tray 11 in the period of time after the preceding paper P1 has separated from the discharge opening 26 (the state shown in FIG. 9), and before a state in which the leading edge of the succeeding paper P2 has landed on the discharge tray 11 (the state shown in FIG. 12), i.e. within the discharge tray shift allowable period.

As described above, the discharge tray shift allowable period is the period from the state shown in FIG. 9 to the state shown in FIG. 12. In other words, this is the time that it takes for the succeeding paper P2 to move the recording paper interval distance (d1 in FIG. 9), which is the distance from the trailing edge of the preceding paper P1 to the leading edge of the succeeding paper P2, and the recording paper release distance (d2 in FIG. 12), which is the horizontal distance from the discharge opening 26 to the point where the leading edge of the succeeding paper P2 landed on the discharge tray 11.

Accordingly, the discharge tray shift allowable period can be obtained by dividing the sum of the recording paper interval distance (d1 in FIG. 9), which is the distance from the trailing edge of the preceding paper P1 to the leading edge of the succeeding paper P2 during transport, and the recording paper release distance (d2 in FIG. 12), which is the horizontal distance from the discharge opening 26 to the point where the leading edge of the succeeding paper P2 landed on the discharge tray 11, by the transport speed of the recording paper P.

Therefore, it is possible to perform optimum control of the discharge tray apparatus 1 by obtaining the above discharge tray shift allowable period (time) in advance, and controlling the tray shift operation of the discharge tray 11 in the discharge tray apparatus 1 with the above-described image recording apparatus control portion using this discharge tray shift allowable time.

According to the above discharge tray apparatus 1, the tray shift operation of the discharge tray 11 is performed with a decelerating movement that reduces the movement speed of the discharge tray 11 just before stopping movement in the tray shift operation of the discharge tray 11. Therefore, it is possible to prevent the disorganization of a bundle of recording paper P that has been placed on the discharge tray 11 even if the tray shift operation of the discharge tray 11 is performed at high speed.

Also, it is possible to perform the tray shift operation of the discharge tray 11 with an accelerating movement that increases the movement speed of the discharge tray 11 just after the start of movement in the tray shift operation of the discharge tray 11. Also, it is possible to perform the tray shift operation of the discharge tray 11 by movement at a uniform speed in which the movement speed of the discharge tray 11 is constant between the accelerating movement and the decelerating movement. Therefore, it is possible to more meticulously prevent the disorganization of a bundle of recording paper P that has been placed on the discharge tray 11 even if the tray shift operation of the discharge tray 11 is performed at high speed.

Also, the tray shift operation is completed within the discharge tray shift allowable period, which is the period from after the trailing edge of the preceding paper P1 has separated from the discharge opening 26 until the leading edge of the succeeding paper P2 lands on the discharge tray 11. Specifically, the tray shift operation of the discharge tray 11 is controlled using as the value of the discharge tray shift allowable period a value that has been obtained in advance, by dividing the sum of the recording paper interval distance (d1 in FIG. 9), which is the distance from the trailing edge of the preceding paper P1 to the leading edge of the succeeding paper P2 during transport, and the recording paper release distance (d2 in FIG. 12), which is the horizontal distance from the discharge opening 26 to the point where the leading edge of the recording paper P landed on the discharge tray 11, by the transport speed of the recording paper P. Therefore, it is possible to accurately place the recorded recording paper P at different positions on the discharge tray 11 of the discharge tray apparatus 1 for each copy unit.

In the above discharge tray apparatus 1, the eccentric cam 16 is rotated in the counter clockwise direction at a fixed speed by a motor built into the eccentric cam drive portion 18, with the eccentric cam shaft 17 as the center axis. Ordinarily, a pulse motor is used as this motor. By using a pulse motor, the rotation of the eccentric cam 16 can be performed in the following manner, rather than with a fixed speed.

Specifically, in the first half turn of the eccentric cam 16, during the first ⅙ turn, the rotational speed of the eccentric cam 16 is increased, and during the next ⅙ turn, the rotational speed of the eccentric cam 16 is fixed, and further, during the next ⅙ turn, the rotational speed of the eccentric cam 16 is reduced. In the remaining half turn of the eccentric cam 16, the rotational speed of the eccentric cam 16 is defined in the same way as defined in the first half turn.

By adopting such a configuration, with respect to the going shift operation performed with the above-described first half turn of the eccentric cam 16, it is possible to further reinforce the effect of accelerating movement of the discharge tray 11 just after starting movement of the discharge tray 11, decelerating movement of the discharge tray 11 just before stopping movement of the discharge tray 11, and moving at a uniform speed between the above accelerating movement and decelerating movement. In the same manner it is possible to reinforce the reversing shift operation in the remaining half turn as well.

The eccentric cam 16 is used in the tray shift operation of the discharge tray 11 in the above-described discharge tray apparatus 1. However, as the mechanism that performs the tray shift operation of the discharge tray 11, other than a mechanism employing the above eccentric cam 16, the mechanism employing a rack and pinion in the previously described conventional example may also be used.

When using a mechanism employing a rack and pinion, in the conventional example, the tray shift operation of the discharge tray was performed by rotating a motor that drives the pinion forward or in reverse at a fixed speed. However, the same operation and effects as in the above-described discharge tray apparatus 1 can be obtained by using the above pulse motor for the motor that drives the pinion, and controlling the above pulse motor such that in the forward or reverse rotation of the pulse motor, the discharge tray 11 is moved in an accelerating manner just after starting movement of the discharge tray 11, moved in a decelerating manner just before stopping movement of the discharge tray 11, and moved at a uniform speed between the accelerating movement and the decelerating movement.

The present technology may be embodied in various other forms without departing from the spirit or essential characteristics thereof. The embodiments disclosed in this application are to be considered in all respects as illustrative and not limiting. The scope of the technology is indicated by the appended claims rather than by the foregoing description, and all modifications or changes that come within the meaning and range of equivalency of the claims are intended to be embraced therein.

What is claimed is:

1. A discharge tray apparatus wherein a plurality of sheets of recording paper that have been successively transported at a fixed speed and a fixed interval, released and discharged in approximately the horizontal direction from a discharge opening, and have landed on a discharge tray from the leading edge to the trailing edge, are received and placed onto the discharge tray, the discharge tray apparatus comprising a discharge tray moving means that performs a tray shift operation that moves the discharge tray in a horizontal direction approximately perpendicular to the discharge direction, such that after a preceding paper successively transported earlier has been placed on the discharge tray, a succeeding paper succeedingly transported after the preceding paper is placed at a position different from the placement position of the preceding paper on the discharge tray, wherein the discharge tray moving means biases the discharge tray with a biasing member from a first side to a second side in the horizontal direction, approximately perpendicular to the discharge direction, performs a first tray shift operation that causes the discharge tray to move in a first direction from the second side toward the first side in the horizontal direction by rotating an eccentric cam having an outer surface that is in contact with the discharge tray a half turn at a fixed speed, and performs a second tray shift operation that causes the discharge tray to move in a second direction that is opposite to the first direction by rotating the eccentric cam in the same direction a further half turn at a fixed speed, and wherein the outer shape of the eccentric cam is such that during the first half turn of the eccentric cam, during the first ⅙ turn, the cam diameter increment, which is the increment of the distance from the rotational axis of the eccentric cam until arriving at a point on the outer circumference of the eccentric cam whenever advancing a unit rotation angle of the eccentric cam, increases, and during the next ⅙ turn, the cam diameter increment whenever advancing the unit rotation angle is fixed, and further, during the next ⅙ turn, the cam diameter increment whenever advancing the unit rotation angle decreases, and in the remaining half turn of the eccentric cam, during the first ⅙ turn, the cam diameter decrement, which is the decrement of the distance from the rotational axis of the eccentric cam until arriving at a point on the outer circumference of the eccentric cam whenever advancing a unit rotation angle of the eccentric cam, increases, and during the next ⅙ turn, the cam diameter decrement whenever advancing the unit rotation angle is fixed, and further, during the next ⅙ turn, the cam diameter decrement whenever advancing the unit rotation angle decreases.

2. The discharge tray apparatus according to claim 1, wherein the discharge tray moving means completes the first or second tray shift operation within a discharge tray shift allowable period, which is a period from after the trailing edge of the preceding paper has separated from the discharge opening until the leading edge of the succeeding paper lands on the discharge tray.

3. The discharge tray apparatus according to claim 2, wherein the discharge tray moving means controls the first and second tray shift operations using as the value of the discharge tray shift allowable period a value that has been obtained in advance, by dividing the sum of the recording paper interval distance, which is the distance from the trailing edge of the preceding paper to the leading edge of the succeeding paper during transport, and the recording paper release distance, which is the horizontal distance from the discharge opening to the point where the leading edge of the recording paper landed on the discharge tray, by the transport speed of the recording paper.

4. The discharge tray apparatus according to claim 1, wherein the discharge tray moving means alternately performs the first tray shift operation and the second tray shift operation.

5. A discharge tray apparatus wherein a plurality of sheets of recording paper that have been successively transported at a fixed speed and a fixed interval, released and discharge in approximately the horizontal direction from a discharge opening, and have landed on a discharge tray from the leading edge to the trailing edge, are received and placed onto the discharge tray, the discharge tray apparatus comprising a discharge tray moving means that performs a tray shift operation that moves the discharge tray in a horizontal direction approximately perpendicular to the discharge direction, such that after a preceding paper successively transported earlier has been placed on the discharge tray, a succeeding paper succeedingly transported after the preceding paper is placed at a position different from the placement position of the preceding paper on the discharge tray, wherein the discharge tray moving means:

biases the discharge tray with a biasing member from a first side toward a second side in the horizontal direction approximately perpendicular to the discharge direction, and performs a first tray shift operation that causes the discharge tray to move in a first direction from the second side to the first side in the horizontal direction approximately perpendicular to the discharge direction by rotating an eccentric cam having an outer surface that contacts the discharge tray a half turn and performs a second tray shift operation that causes the discharge tray to move in a second direction opposite to the first direction by rotating the eccentric cam in the same direction a further half turn, and in the first half turn of the eccentric cam, during the first ⅙ turn, the rotational speed of the eccentric cam is increased, and during the next ⅙ turn, the rotational speed of the eccentric cam is fixed, and further, during the next ⅙ turn, the rotational speed of the eccentric cam is reduced, and in the remaining half turn of the eccentric cam, the rotational speed of the eccentric cam is defined in the same way as defined in the first half turn, the outer shape of the eccentric cam being such that in the first half turn of the eccentric cam, during the first ⅙ turn, the cam diameter increment, which is the increment of the distance from the rotational axis of the eccentric cam until arriving at a point on the outer circumference of the eccentric cam whenever advancing a unit rotation angle of the eccentric cam, increases, and during the next ⅙ turn, the cam diameter increment whenever advancing the unit rotation angle is fixed, and further, during the next ⅙ turn, the cam diameter increment whenever advancing the unit rotation angle decreases, and in the remaining half turn of the eccentric cam, during the first ⅙ turn, the cam diameter decrement, which is the decrement of the distance from the rotational axis of the eccentric cam until arriving at a point on the outer circumference of the eccentric cam whenever advancing a unit rotation angle of the eccentric cam, increases, and during the next ⅙ turn, the cam diameter decrement whenever advancing the unit rotation angle is fixed, and further, during the next ⅙ turn, the cam diameter decrement whenever advancing the unit rotation angle decreases.

6. The discharge tray apparatus according to claim 5, wherein the discharge tray moving means completes the first or second tray shift operation within a discharge tray shift allowable period, which is a period from after the trailing edge of the preceding paper has separated from the discharge opening until the leading edge of the succeeding paper lands on the discharge tray.

7. The discharge tray apparatus according to claim 6, wherein the discharge tray moving means controls the first and second tray shift operations using as the value of the discharge tray shift allowable period a value that has been obtained in advance, by dividing the sum of the recording paper interval distance, which is the distance from the trailing edge of the preceding paper to the leading edge of the succeeding paper during transport, and the recording paper release distance, which is the horizontal distance from the discharge opening to the point where the leading edge of the recording paper landed on the discharge tray, by the transport speed of the recording paper.

8. The discharge tray apparatus according to claim 5, wherein the discharge tray moving means alternately performs the first tray shift operation and the second tray shift operation.

* * * * *